US008020420B2

(12) United States Patent
Frattini

(10) Patent No.: US 8,020,420 B2
(45) Date of Patent: Sep. 20, 2011

(54) APPARATUS FOR CONTINUOUSLY PERFORMING LOCALIZED AND/OR EXTENDED DEFORMATION ON METALLIC CONAINERS

(75) Inventor: Roberto Frattini, Ponteranica (IT)

(73) Assignee: Frattini S.p.A. Costruzioni Meccaniche, Seriate (IT)

( * ) Notice: Subject to any disclaimer, the term of this patent is extended or adjusted under 35 U.S.C. 154(b) by 972 days.

(21) Appl. No.: 11/886,021

(22) PCT Filed: May 20, 2005

(86) PCT No.: PCT/IB2005/001624

§ 371 (c)(1),
(2), (4) Date: Sep. 10, 2007

(87) PCT Pub. No.: WO2006/095215

PCT Pub. Date: Sep. 14, 2006

(65) Prior Publication Data

US 2008/0199278 A1 Aug. 21, 2008

(30) Foreign Application Priority Data

Mar. 11, 2005 (IT) ..... MI2005A0397

(51) Int. Cl.
*B21D 51/26* (2006.01)

(52) U.S. Cl. ..... 72/94; 72/405.03

(58) Field of Classification Search ..... 72/94, 405.03, 72/379.4, 715; 198/469.1, 470.1, 346.2, 198/407, 474.1
See application file for complete search history.

(56) References Cited

U.S. PATENT DOCUMENTS

| | | | | |
|---|---|---|---|---|
| 4,732,027 | A | 3/1988 | Traczyk et al. | |
| 6,484,550 | B2 * | 11/2002 | Halasz et al. | 72/353.4 |
| 6,520,318 | B1 * | 2/2003 | Humele | 198/483.1 |
| 2002/0029599 | A1 * | 3/2002 | Heiberger et al. | 72/94 |

FOREIGN PATENT DOCUMENTS

JP 2002102968 4/2002

OTHER PUBLICATIONS

International Search Report.

* cited by examiner

*Primary Examiner* — Edward Tolan
*Assistant Examiner* — Matthew G Katcoff
(74) *Attorney, Agent, or Firm* — Bucknam and Archer

(57) ABSTRACT

Apparatus (10) for continuously performing localized and/or extended deformations on metallic containers constituted by extruded or drawn and solid-drawn tubular bodies including: —A) interface module (1); —B) at least one work module (2, 2', 2") and —C) possibly one inversion module (3), wherein said modules are arranged so that they form a closed path and said interface module (1) includes a feeding station or drum (12), an unload drum (16) and at least one selective dispatch element for re-feeding the containers to the work modules (2, 2', 2") or the unload drum (16), depending on the number of predetermined operations.

12 Claims, 6 Drawing Sheets

APPARATUS FOR CONTINUOUSLY PERFORMING LOCALIZED AND/OR EXTENDED DEFORMATION ON METALLIC CONAINERS

CROSS REFRENCE TO RELATED APPLICATIONS

Applicant claims priority under 35 U.S.C. §119 of Italian Application No. MI2005A000397 filed Mar. 11, 2005. Applicant also claims priority under 35 U.S.C. §365 of PCT/IB2005/001624 filed May 20, 2005. The international application under PCT article 21 (2) was published in English.

The present invention relates to an apparatus for continuously performing localized and/or extended deformations on metallic containers.

More particularly, the present invention relates to an apparatus specifically and non critically adapted for sequentially and continuously performing operations of deforming lateral surface, as well as bottom if required, of aluminium metallic containers, alloys thereof, steel and other suitable materials. Metallic containers of this type undergo multiple operations of deformation and/or coning starting from extruded cylindrical bodies or drawn and solid-drawn of very small thickness.

As used in the present description and claims, the term metallic container, includes also tubular bodies, whose extreme ends are open or one of them is closed.

Said bodies, before the series of operations which will deform and/or cone the lateral surface thereof, or part of it, can be externally and/or internally varnished and lithographed along their external lateral surface. The lithography is used to realize, on the cut bodies, writings and decorations in multiple colours, together with indications on the content thereof and information for the end user.

The apparatus of the present invention realizes the operations on metallic containers, e.g. spray bottles, beverages cans and the like, specifically during the final phases of the process, when a tubular-shaped container with one of its ends still open, undergoes a plastic deformation modifying its geometric shape (shaping), localization (necking, coning) or surface shape (embossing/debossing).

Many different types of metallic containers are known in the art, typically destined to food & beverages and aerosol fields. The production of these type of containers is characterized by remarkable differences, especially with reference to a higher or lower complexity depending on the number of single operations required. The machines used, as a consequence, are very different, both in terms of structure and production capacity.

The different kind of productions can be classified with reference to the following parameters:

production rate, high or low and production complexity, high or low.

The containers destined to beverages, as cans or pop cans, are not characterized by high level of production complexity; the operations required in order to obtain the end body from the cut piece imply a number of operations generally lower than fifteen work stations. The production rate of these containers generally can be high.

The containers destined to aerosol applications, on the other hand, undergo a more complex process; the number of operations required is very high, and production rate thereof, is therefore, usually lower.

The devices used to obtain said types of containers are therefore specific they allow to process a very high number of containers with a very low construction complexity, such as those used in the beverages field, or a low number of containers with a high complexity level, such as those used in the aerosol field.

At present, it is further more and more felt the need to realize, also for the beverage field, complex containers called bottle can, featuring shapes or deformations extending through the whole lateral surface or a large part of it. This need represents an evolution which, in the beverage field, tends to substitute or constitute an alternative to glass or PET containers, reproducing, on a metallic container, aesthetical characteristics thereof. This hypothesis holds a double problem, since the quantity of bottle cans in the beverage filed is very high, as much as the production difficulties introduced by their realization: containers of this kind might even require fifty work stations in the process.

The known art of making pop can containers for the beverage field contemplates the use of an in line production system, where containers are progressively moved from the line in through the line out accordingly to a substantially sine-like path and progressively undergo processing on rotating plates including a certain number of operative stations using the same kind of tools. This known solution presents the drawback of large overall dimensions, considering that each single operation requires a specific rotating plate.

The production of aerosol containers, where production difficulties are numerous because of the number of deformations required, alternate translating table devices are used bringing a plurality of tools and drills for sequential operations. These devices nevertheless present the drawback of a low production rate.

The object of the present invention is to avoid the previously reported drawbacks.

More particularly, the object of the present invention is to provide an apparatus for continuously making localized and/or extended deformations on metallic containers which is fit to realize a high number of said containers, also in case of a large number of sequential operations, without implying the use of a large installation area.

Further object of the present invention is to provide an apparatus as previously described which can be conveniently tooled for different operations on metallic containers destined to both beverage field and aerosol field, therefore creating a system characterized by great flexibility and modularity.

Further object of the present invention is to provide an apparatus fit to be easily expanded with added modules in accordance to the production needs.

In accordance with the present invention, the previous and further objects can be obtained by the apparatus for continuously performing localized and/or extended deformations on metallic containers according to the features of the main claim.

Constructive and functional characteristics of the apparatus for continuously performing localized and/or extended deformations on metallic containers of the present invention will be better understood from the following description, with reference to the drawing, tables enclosed representing a preferred embodiment where:

Figure 1:
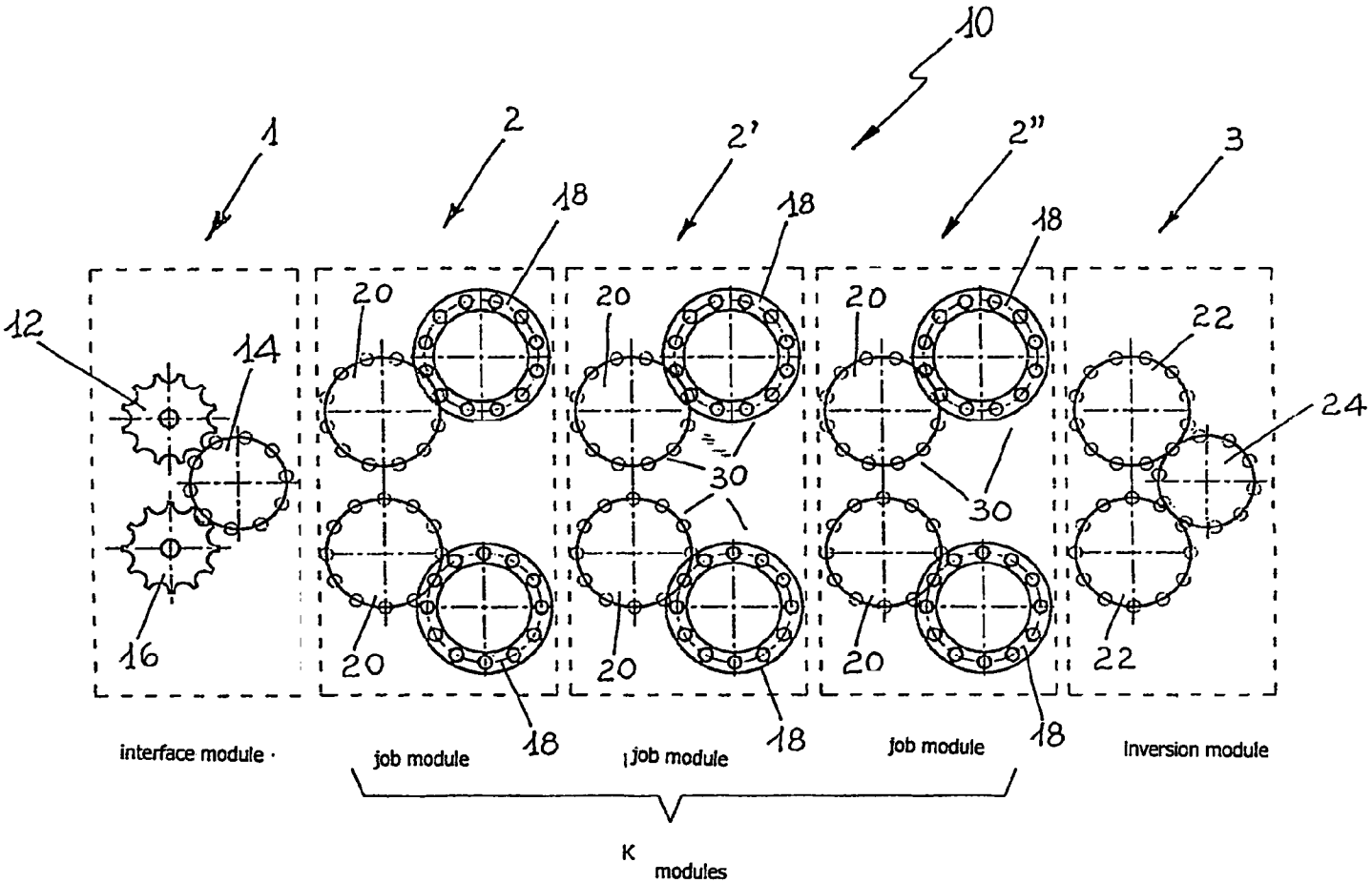
FIG. 1 shows a structural scheme of the apparatus of the present invention .accordingly to an example embodiment of a type of operation.
Figure 1A:
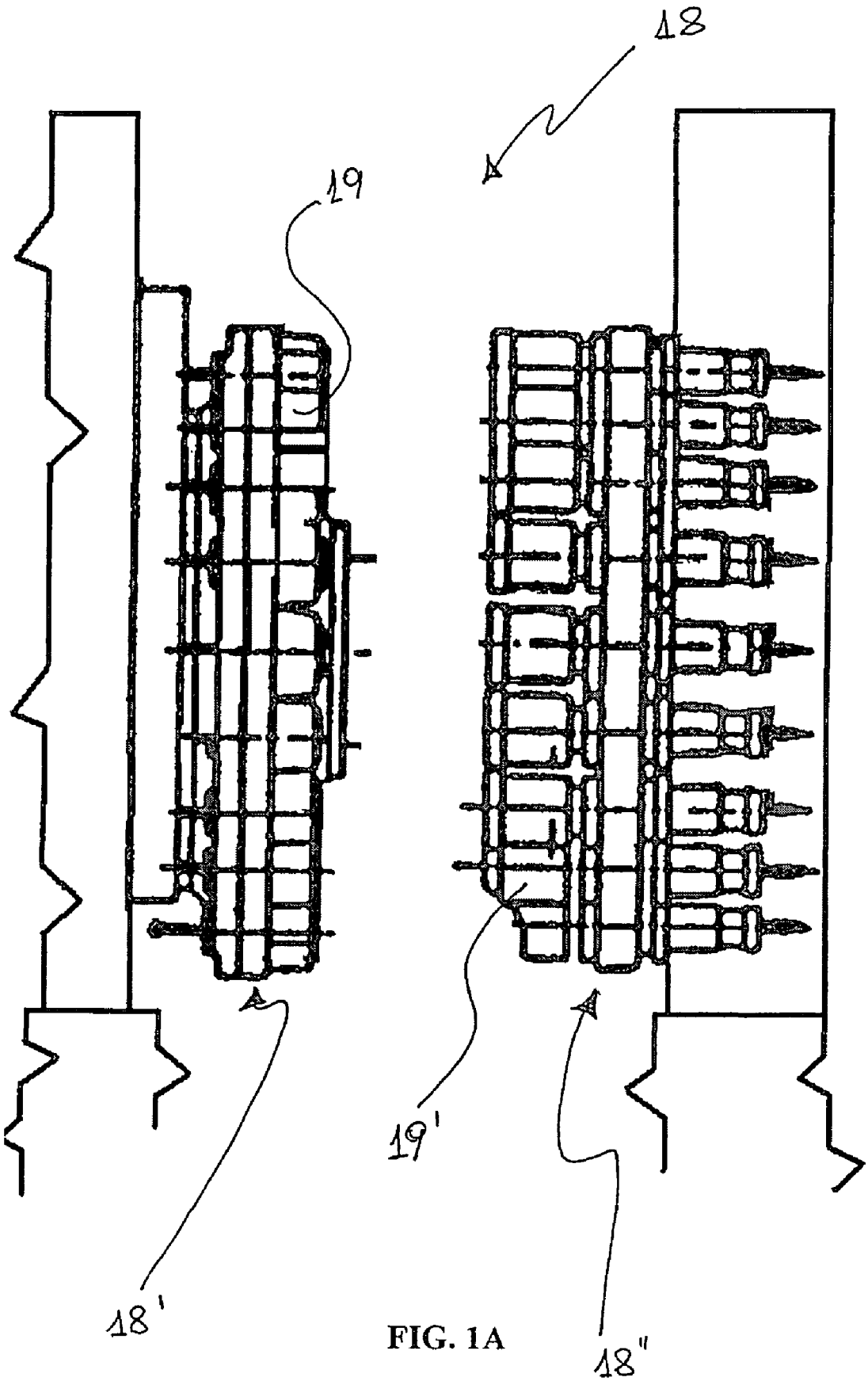
FIG. 1A shows a detailed view of a portion of the apparatus of the present invention with reference to the tools used in the apparatus.

With reference to said figures, the apparatus for continuously performing localized and/or extended operations on metallic containers of the present invention, indicated as 10 in FIG. 1, includes a interface module 1, at least a job module 2, 2', 2" and possibly an inversion module 3, arranged so that they form a closed path.

The interface module 1 includes a feeding station or drum 12, a first change drum 14 fit to receive containers from feeding drum 12 and an unloading station or drum 16.

Each job module 2, 2', 2" includes at least a tower 18 and a transfer drum 20. One tower 18 and one transfer drum 20 represent a work station 30. In accordance with a preferred embodiment of the present invention each job module 2, 2', 2" includes two work stations 30. Each tower 18 is provided with a plurality of operative stations corresponding to the same number of equal or different type of dies. Transfer drums 20 cooperate with change drum 14 and/or towers 18 in order to transfer containers from the interface module 1 to the single job. module 2, 2', 2" and from them to the inversion module 3. Said last module includes a change drum 24 and two further lateral transfer drums 22 synchronously rotating, functionally connected to said change drum 24; each drum 24, 22 being provided with seal means.

Lateral transfer drums 22 are functionally connected to towers 18 for transferring the containers.

In the embodiment of the example in accordance with the figures, each tower 18 includes twelve operative stations, but it is understood that their number can be higher or lower, e.g. from 5 to 50, accordingly to the production needs. Each of said elements, drums and towers, is constituted by a disk or plate where seats for a defined number of containers have been set, with the option of rotating around the axis of the disk itself; said rotation allows the apparatus's parts to move, but each one of said parts is not allowed to move relatively to the disk, except during the load/unload operations. The moving of the containers to be processed within the apparatus is therefore equal to what happens within a transport chain, where the position of each container is always managed since always integral with the links of the chain.

In accordance with a preferred embodiment, but not limited to it, said elements, i.e. towers 18, transfer drums 20, 22 and change drums, 14, feeding stations 12 and unload stations 16, are arranged with their rotation axes parallel to each other, so that the movement of the containers under process takes place approximately on a unique plane perpendicular to said axes, and they are all characterized by a synchronous rotation movement.

Figure 2:
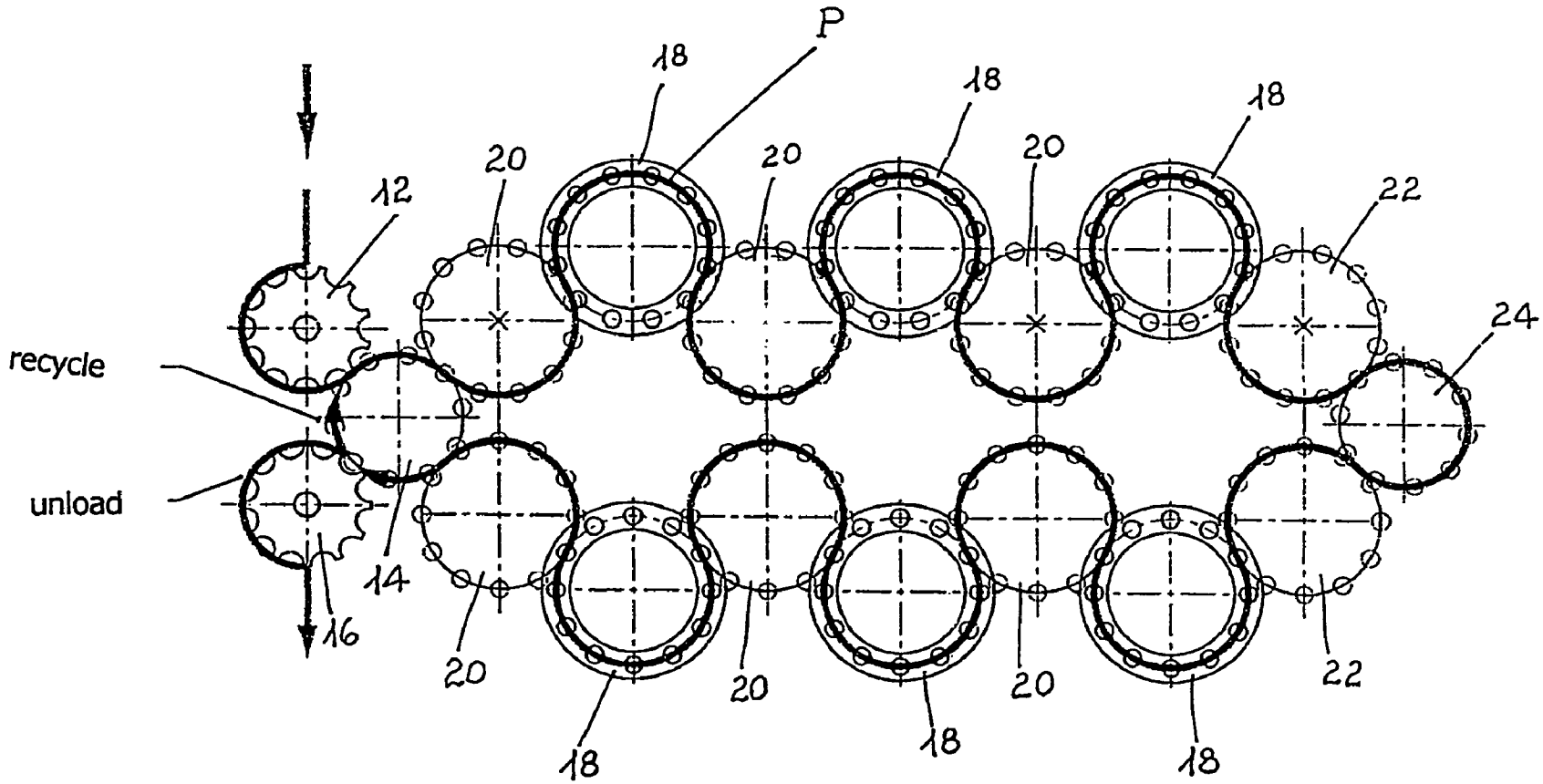
FIG. 2 shows a functional scheme of the closed path of the container within the apparatus of the present invention.

Multiple drums 14, 20, 22, 24 and towers 18 are arranged on the apparatus 10 according to a closed development or path as indicated in FIG. 2; while the feeding stations or drums 12 and unload drums 16 are placed externally to said path and adjacent to the change drum 14. Each tower 18 includes rotating table 18' provided with gripping pliers 19 and a rotating table 18" provided with tools 19', both having a symmetry axis in common. The gripping pliers 19 and tools 19' are well known in the prior art and will not be further described herein.

Each processing on the containers takes place on towers 18, rotating with a continuous synchronous movement around their symmetry axis. Along the perimeter of each rotating table is set a certain number of slots or seats fit to house, respectively and in opposition to each other, the locking devices of the containers and the forming dies. The rotation of the tables around their axis determines, through kinematisms known in the art (and therefore not described in details), the relative movement between die and container originating the process.

In accordance to a preferred embodiment, the dies of the containers are fixed relatively to the first rotating table, while the pliers are integral with the second rotating table through a prismatic coupling and are therefore free to move in a direction parallel to the rotation axis of the tables. Nevertheless embodiments providing for the possibility of a movement of the first, the second or both tables are possible.

During the steady running of the apparatus, the majority of the gripping means or pliers is occupied by a container in process, in order to obtain a simultaneous processing of multiple containers on each single tower.

The structure of the apparatus is modular; the feeding stations 12 and unload stations 16 and the change drum 14 represent the interface module 1; the other change drum 24 and two transfer drums 22 represent the inversion module 3. The middle part of the apparatus located between said modules 1 and 3 includes a certain number (K) of job modules 2, 2', 2" which, in the preferred and not-limitative embodiment, are equal to each other and each of them comprises two towers 18 and two transfer drums 20. Nevertheless, a solution where job modules contain a different number of towers 18 and/or transfer drums 20, equal or different to each other, has to be provided for.

The reference to the positioning of the elements within the apparatus, shown in FIG. 1, is relevant, since the overall architecture of the apparatus itself allows the possibility of a closed path of the containers under process. In addition, the overall dimensions of the apparatus, depending on the number of work modules installed, might became relevant and therefore it is desirable to limit its dimensions as much as possible.

Change drums 14, 24 are mainly used for closing the containers path; further, the same change drums, co-operate to realize the correct positioning of the containers under process on towers 18, in order to position them at the right time in contact with the die which is appropriate for the operation to be realized. In accordance with the present invention, each single container can be re-cycled one or more times on towers 18 which are provided with equal or different dies.

The number of different dies mounted on a each single tower equals the number of cycles/recycles done by the containers and goes from 1 to H, H being the number of deformation tools on each single tower 18 in order to allow the execution, of all the different process stages on the containers during the relative recycles in the apparatus.

During the recycle/s, the container which has been already processed will be positioned on towers 18 in a different position compared to the previous one, so that it will face a different die.

If the process management provides for a number of recycles equal to the number of dies present on each tower 18, every container in process will visit all the seats present on each tower, during the scheduled cycles.

Provided that the position of each container under process is always known, and provided that all the seats on towers 18 are well known, on transfer drums 20, 22 and on change drums 14, 24, correct positioning of the containers themselves within the apparatus is made possible by choosing the number of seats present on the same change drums 14, 24. In particular, the total number (P) of containers processed within the closed path and the number of dies (H) are chosen not to have any divider in common. In other words, P and H are dissimilar prime numbers.

The first change drum 14, besides mating with the adjacent transfer drums 20, engages with the two feeding and unload stations 12, 16 which load and unload the containers even if just on some of the seats available.

It is indeed possible that the feeding station 12 leaves a certain number of seats free, which will be occupied on the drum connected thereto (change drum 14 o other device) by the containers under re-cycle; similarly, the unload station 16, cooperating with change drum 14 connected thereto, fulfils the task to withdraw exclusively and selectively the containers that have been completely processed, when all the cycles scheduled have been performed. The union of all the elements carrying out said function is referred to as selective dispatch element. In the solution shown in the figures, the selective dispatch element is constituted by drum 14, together with the unload station or drum 16. Any known means may be used as selective dispatch element, such as a mechanic, pneumatic or magnetic system.

Figure 3:
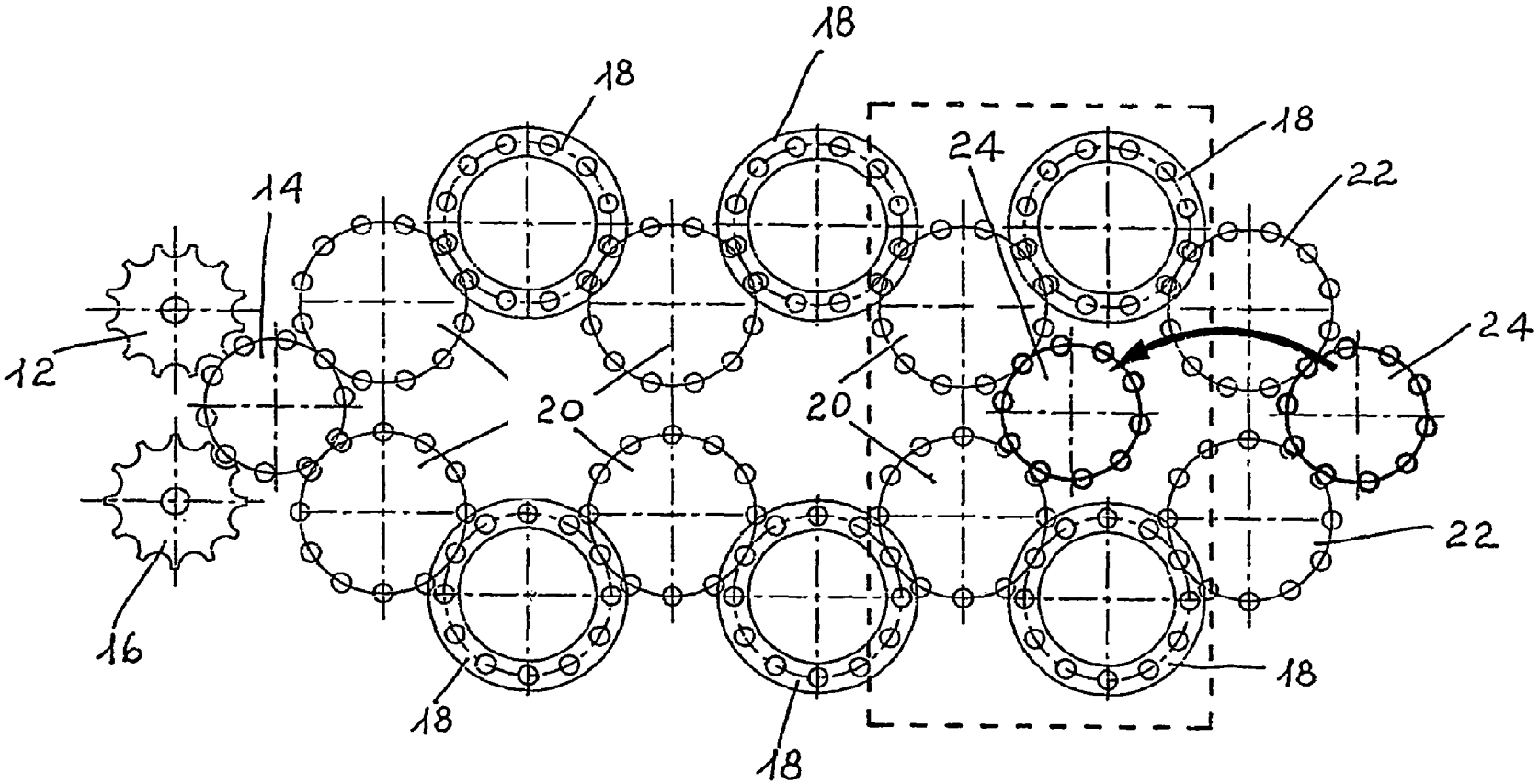
FIG. 3 shows a functional scheme of a possible configuration of the apparatus of the present invention.

After all, the apparatus includes, at least in the preferred embodiment, an interface module 1, a number K of job modules 2, 2', 2" and an inversion module 3, where K may be any number depending on the operations to be performed. The possibility to house a change drum 24 within any of the job modules 2, 2', 2", has to be provided for; this embodiment is illustrated in FIG. 3, wherein change drum 24 is connected to transfer drums 20 by-passing the following towers 18; the module, accordingly to said modification, becomes functionally equivalent to an inversion module 3 and allows to by-pass the following work modules, with great management and plant advantages.

For example the advantages obtainable, might be the following, but not limited to them.

Figure 4:
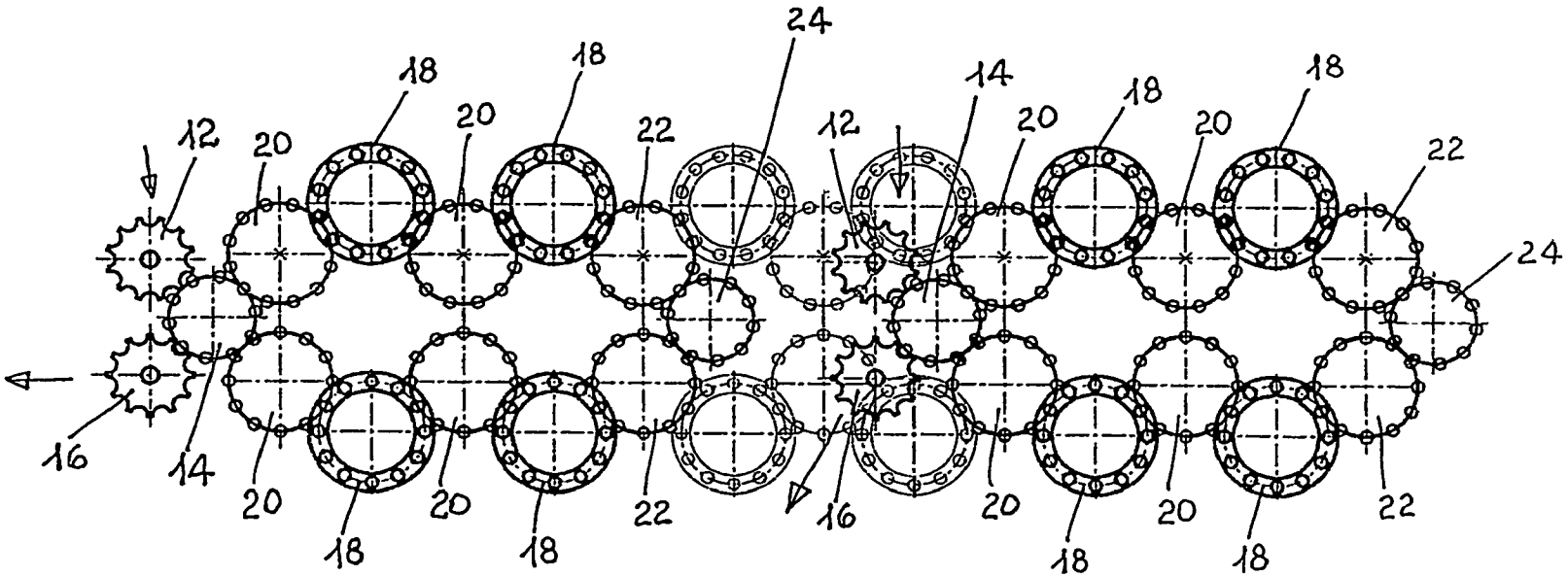
FIG. 4 shows a schematic view of the usage of the apparatus for simultaneous production of two different products.

1) tooling only of work stations 30 necessary to product processing;
2) possibility to use non-operating stations 30 for maintenance and re-tooling;
3) possibility to use the apparatus for processing two or more different products at the same time (see FIG. 4).

In order to perform cycles/recycles, implying position stagger of the containers to be processed on towers 18, on feeding drum 12 a predetermined number of seats is required to be left free; coherently, on change drum 14 a corresponding number of seats will be left free, which will be occupied by the containers under recycle. In the same way, the unload drum 16 withdraws only completely processed containers at the end of all the scheduled recycles.

Figure 5:
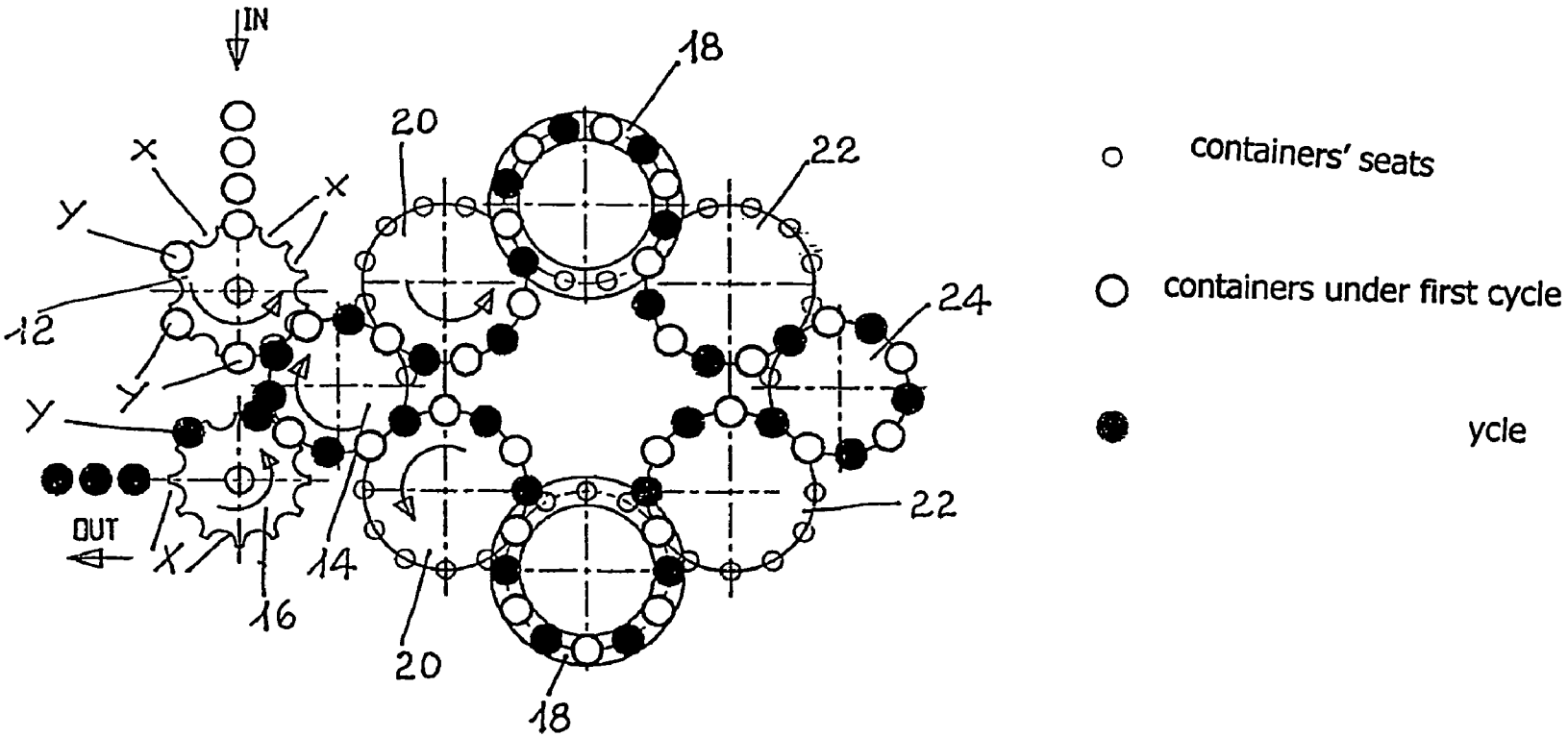
FIG. 5 shows a schematic view of the configuration of the apparatus in case of a re-cycle.

For example, FIG. 5 shows the case of a single recycle: feeding station 12 has its seats alternatively empty "X" or occupied "Y", such as the unload station 16, while the change drum 14 is almost completely occupied. Similarly, in the case of two recycles, feeding and unload stations will have a seat occupied by a container every three seats.

In the apparatus of the present invention, the maximum number of operative steps which can be realized on a container is given by N×H; where N is the number of towers 18 present and H is the number of seats per tower and the maximum number of cycles/recycles which can be realized. By reducing the number of recycles, the number of operative steps obtainable on a container will accordingly be reduced and the production rate increased.

The presence of such number "M" of cycles/recycles in the apparatus (M goes from 1 to H) reduces production rate to one $M^{th}$, but it allows a number of process steps M times higher; this recycle process technique, further, makes advantageously possible to reduce the overall dimensions of the apparatus.

Said apparatus may be easily modified (see FIG. 3 and FIG. 4) accordingly to the production needs and/or operative steps required, adding or excluding some of the work stations 30, tooling just the towers 18 which will be really used and allowing other operations on modules not in use. On this purpose a second input and a second output can be provided for, i.e. other feeding 12 and unload 16 stations 12 for containers to be processed in a different manner (see FIG. 4).

Complex phases, requiring a high number of steps (shaping, necking of thin necks and so on) can be performed on the same device, providing a higher number of recycles, to the detriment of hour productivity. Conversely, the solution without recycles (where M=1, towers 18 have been tooled with equal dies and all containers have been unloaded from change drums 14) leads the maximum productivity.

The apparatus, in its different, configurations, makes possible to obtain the same level of performance given by the corresponding solution of the known art, gathering in a single apparatus all the production potentialities provided by different groups of dedicated tools. In addition to the high level of configurability, the system flexibility is guaranteed by the apparatus's modular structure. It is possible, depending on the productivity characteristics and/or number of steps required, to add or exclude some of the job modules 2, 2', 2" or work stations 30, tooling only towers 18 that are going to be actually used allowing, eventually, other operations, e.g. the use of a different line, a new tooling operation or programmed maintenance on modules not in use. This type of intervention may be realized modifying any of the job modules 2, 2', 2" by introducing or moving a change drum 24, as illustrated in FIG. 3; this solution implies the exclusion of module's towers 18 from production cycle, but it allows to realize modifications without any physical movement of the modules. It is also possible to reconfigure the production units by introducing or physically removing said work modules, consequently repositioning the inversion module 3.

Although the apparatus of the present invention has been described herein with reference to the figures enclosed, it is understood that various modifications and variants may be introduced by a person skilled in the art based on the description previously reported.

The present invention therefore covers all the modifications and variants which fall within the protection scope as defined by the appended claims.

The invention claimed is:

1. An apparatus for continuously performing localized and/or extended deformations on metallic containers constituted by extruded or drawn and solid-drawn tubular bodies, comprising:

a) an interface module (1), including a feeding station or feed drum (12) and an unloading station or unloading drum (16);

b) at least one job module (2, 2', 2"), having a first work station (30) and a second work station (30), each work station (30) including an operative tower(18) and a transfer drum (20), wherein each tower (18) includes a first rotating table (18") having a plurality of deformation tools (19') and a second rotating table (18') having a plurality of gripping devices (19), said first and second rotating tables (18", 18') having a synchronous coaxial rotational movement, said deformation tools (19') and said gripping devices (19) being adapted for relative axial movement therebetween, the transfer drum (20) of said first work station (30) cooperating with the feeding station (12) and the transfer drum (20) of said second work station (30) cooperating with the unloading station (16);

c) an inversion module (3), including a first transfer drum (22) cooperating with said first work station (30) of said at least one job module (2, 2', 2"), a second transfer drum (22) cooperating with said second work station (30) of said at least one job module (2, 2', 2"), and a change drum (24) cooperating with said first and second transfer drums (22);

said interface module (1), at least one job module (2, 2', 2"), and inversion module (3) are arranged so as to form a closed path for said containers; and d) a selective dispatch element cooperating with said interface module (1) for re-feeding selected containers from the second work station (30) to the first work station (30) of said at least one job module (2, 2', 2") and transferring completely processed containers from the second work station (30) of said at least one job module (2, 2', 2") to said unloading station (16).

2. The apparatus as claimed in claim 1, wherein transfer drums (20) cooperate with the selective dispatch element for transferring of containers from said interface module (1) to said at least one job module (2, 2', 2") and then to the inversion module (3).

3. The apparatus as claimed in claim 2, wherein total number (P) of containers included in the closed path and the number of deformation tools (19') or gripping devices (19) is chosen in a way not to have a divider in common.

4. The apparatus as claimed in claim 3, which further includes a change drum (24) seated within any of said at least one job module (2, 2', 2") and functionally connected to transfer drums (20) of each work station (30).

5. The apparatus as claimed in claim 2, wherein the selective dispatch element is a mechanical device.

6. The apparatus as claimed in claim 2, wherein the selective dispatch element is a pneumatic device.

7. The apparatus as claimed in claim 2, wherein the selective dispatch element is a magnetic device.

8. The apparatus as claimed in claim 1, wherein the first rotating table (18') of said tower (18) is provided with identical deformation tools (19').

9. The apparatus as claimed in claim 1, wherein the first rotating table (18') of said tower (18) is provided with deformation tools (19') which are different one from the other.

10. The apparatus as claimed in claim 4, wherein drums of the interface module (1), drums of the towers (18), transfer drums (20, 22), drums of the inversion module (3) are arranged with their rotation axes parallel with each other and they are all provided with a synchronous rotating movement.

11. The apparatus as claimed in claim 9, wherein the number of different dies mounted on each tower (18) equals the number of cycles/recycles done by the containers, and goes from 1 to H, and a maximum number of operative work steps that can be performed on a container is given by N×H, where N is the number of towers (18) and H is the number of deformation tools (19') of each tower (18).

12. The apparatus as claimed in claim 1, characterized in that among said at least one job module (2, 2', 2") a plurality of feeding stations (12) and unload stations (16) are included in order to realize other operations on modules not belonging to the closed path.

* * * * *